US007856759B2

(12) United States Patent
Elliott et al.

(10) Patent No.: US 7,856,759 B2
(45) Date of Patent: Dec. 28, 2010

(54) DUAL ACTION POWER DRIVE UNIT FOR A VEHICLE DOOR

(75) Inventors: Adrian Nicholas Alexander Elliott, Dearborn, MI (US); Dave Michael Lechkun, Shelby Township, MI (US); Bryan K. Farris, Livonia, MI (US); Lyle Dadd, West Bloomfield, MI (US); Henry Hausler, Manchester, MI (US)

(73) Assignees: Ford Global Technologies, LLC, Dearborn, MI (US); GECOM Corporation, Greensburg, IN (US)

( * ) Notice: Subject to any disclaimer, the term of this patent is extended or adjusted under 35 U.S.C. 154(b) by 222 days.

(21) Appl. No.: 12/338,421

(22) Filed: Dec. 18, 2008

(65) Prior Publication Data

US 2010/0154313 A1 Jun. 24, 2010

(51) Int. Cl.
*E05F 11/00* (2006.01)

(52) U.S. Cl. ..... 49/358; 49/360

(58) Field of Classification Search ..... 49/358, 49/360; 296/146.1, 155
See application file for complete search history.

(56) References Cited

U.S. PATENT DOCUMENTS

| | | | | |
|---|---|---|---|---|
| 3,051,999 | A | 9/1962 | Schimek | |
| 3,075,803 | A | 1/1963 | Wilfert | |
| 3,313,063 | A | 4/1967 | Patin | |
| 3,619,853 | A | 11/1971 | Merrill | |
| 3,628,216 | A | 12/1971 | Savell | |
| 3,935,674 | A | 2/1976 | Williams et al. | |
| 4,025,104 | A | 5/1977 | Grossbach et al. | |
| 4,135,760 | A | 1/1979 | Grossbach | |
| 4,945,677 | A | 8/1990 | Kramer | |
| 5,139,307 | A | 8/1992 | Koops et al. | |
| 5,144,769 | A * | 9/1992 | Koura | 49/360 |
| 5,155,937 | A * | 10/1992 | Yamagishi et al. | 49/280 |
| 5,251,953 | A | 10/1993 | Willey | |
| 5,398,988 | A | 3/1995 | DeRees et al. | |

(Continued)

FOREIGN PATENT DOCUMENTS

| | | |
|---|---|---|
| DE | 3831698 | 3/1990 |

(Continued)

*Primary Examiner*—Jerry Redman
(74) *Attorney, Agent, or Firm*—Gregory P. Brown; Price, Heneveld, Cooper, DeWitt & Litton, LLP

(57) ABSTRACT

A power drive unit system includes a vehicle door, a slide member, a motor, first and second cable guide members, first and second cables, an external spool, a door inner panel and one guide track. The internal spool unit includes an internal spool. The motor operatively communicates with the internal spool. The first cable guide member is associated with a first cable and the external spool. The first cable is attached to the internal spool and the external spool. The second cable guide member is associated with a second cable and the external spool. The second cable is attached to the internal cable spool the external spool, which in turn communicates with an output gear. The motor actuates the internal cable spool to pull the second cable, thereby causing rotation of the external spool and the drive shaft. The rotation of the drive shaft results in rotation of the door relative to the body; after which the door slides open.

16 Claims, 5 Drawing Sheets

U.S. PATENT DOCUMENTS 5,507,119 A 4/1996 Sumiya et al.
5,551,190 A * 9/1996 Yamagishi et al. ..... 49/360
5,561,887 A 10/1996 Neag et al.
5,806,246 A * 9/1998 Azuma ..... 49/360
5,812,684 A 9/1998 Mark
5,846,463 A 12/1998 Keeney et al.
5,921,613 A 7/1999 Breunig et al.
6,030,025 A 2/2000 Kanerva
6,183,039 B1 2/2001 Kohut et al.
6,196,618 B1 3/2001 Pietryga et al.
6,213,535 B1 4/2001 Landmesser et al.
6,299,235 B1 10/2001 Davis et al.
6,382,705 B1 5/2002 Lang et al.
6,394,529 B2 5/2002 Davis et al.
6,447,054 B1 9/2002 Pietryga et al.
6,530,619 B2 * 3/2003 Fukumoto et al. ..... 296/155
6,572,176 B2 6/2003 Davis et al.
6,629,337 B2 10/2003 Nania
6,793,268 B1 9/2004 Faubert et al.
6,802,154 B1 10/2004 Holt et al.
6,817,651 B2 11/2004 Carvalho et al.
6,826,869 B2 12/2004 Oberheide
6,860,543 B2 3/2005 George et al.
6,926,342 B2 8/2005 Pommeret et al.
6,935,071 B2 * 8/2005 Yokomori et al. ..... 49/360
6,942,277 B2 9/2005 Rangnekar et al.
6,997,504 B1 2/2006 Lang et al.
7,000,977 B2 2/2006 Anders
7,003,915 B2 2/2006 Yokomori
7,032,953 B2 4/2006 Rangnekar et al.
7,104,588 B2 9/2006 George et al.
7,168,753 B1 1/2007 Faubert et al.
7,178,853 B2 2/2007 Oxley et al.
7,219,948 B2 5/2007 Curtis, Jr. et al.
7,243,978 B2 7/2007 Mather et al.
7,328,934 B2 * 2/2008 Sato ..... 296/155
7,337,581 B2 * 3/2008 Kriese ..... 49/360
7,393,044 B2 7/2008 Enomoto
7,469,944 B2 12/2008 Kitayama et al.
7,533,926 B2 * 5/2009 Mitsui et al. ..... 296/155
7,552,953 B2 6/2009 Schmoll et al.
7,611,190 B1 11/2009 Elliott et al.
7,640,627 B2 1/2010 Lowen et al.
7,669,367 B2 * 3/2010 Shimura et al. ..... 49/213
7,708,334 B2 * 5/2010 Yamada et al. ..... 296/146.4
2002/0096800 A1 7/2002 Keeney et al.
2003/0218358 A1 11/2003 Hahn
2004/0070231 A1 * 4/2004 Yogo et al. ..... 296/155
2004/0155617 A1 * 8/2004 Suzuki ..... 318/434
2005/0093337 A1 5/2005 Herrmann et al.
2005/0116496 A1 6/2005 Lowson et al.
2005/0146159 A1 7/2005 Shen et al.
2006/0059799 A1 3/2006 Zimmer et al.
2006/0103047 A1 5/2006 Zwolinski
2006/0267375 A1 11/2006 Enomoto
2007/0075565 A1 4/2007 Magsaam
2007/0085374 A1 4/2007 Mather et al.
2008/0190028 A1 8/2008 Oxley
2008/0224501 A1 9/2008 Zimmer et al.
2009/0070960 A1 3/2009 Elliott et al.
2009/0072582 A1 3/2009 Elliott et al.
2009/0072583 A1 3/2009 Elliott et al.

FOREIGN PATENT DOCUMENTS

EP 1813759 8/2007
JP 3140583 6/1991
JP 3140584 6/1991
JP 2007/138630 6/2007
KR 100448753 9/2004
WO WO2006/005572 1/2006

* cited by examiner

DUAL ACTION POWER DRIVE UNIT FOR A VEHICLE DOOR

BACKGROUND

The present disclosure relates generally to power drive units, and more particularly to such devices for vehicle doors.

Swinging and sliding doors for motor vehicles are known that have a door panel and at least one pivoting arm secured to the wall of the vehicle, with a carriage articulated to the end of the arm, the arm sliding back and forth on a carrier connected to the door panel. Doors of this type are opened and closed manually and incorporate guide mechanisms that ensure that the panel will start to open by pivoting out of the doorway, after which it can be slid to a fully open position.

Combining such doors with a drive mechanism secured to the vehicle body is also known. Such drive mechanisms generally employ a wheel to drive a flexible linear-transmission element, for example a steel cable, guided by rollers and attached to the door panel to generate the sliding motion. The swinging motion, however, is then induced by appropriate guide structures or generated by a second wheel connected to the arm. The two different motions are therefore obtained with different motors in the known doors. The use of two motors may make manufacturing such a device complicated and expensive. This traditional arrangement also requires a great deal of space on the vehicle body therefore limiting potential usage of this design on various vehicles.

SUMMARY

A dual action power drive unit system according to embodiment(s) disclosed herein includes a vehicle door, a slide member, a motor, first and second cable guide members, first and second cables, and an external spool. The system further includes a door inner panel and one guide track affixed to the door inner panel. The slide member is disposed on the guide track. The internal cable spool unit is affixed to the slide member wherein the internal spool unit includes an internal cable spool. A motor is disposed proximate to the internal spool such that the motor is in operative communication with the internal spool. The first cable guide member is operatively associated with a first cable and an external spool. The first cable includes a first end and a second end. The first end of the first cable is attached to the internal cable spool. The second end of the first cable is attached to the external spool. The second cable guide member is operatively associated with a second cable and the external spool. The second cable includes a first end and a second end. The first end of the second cable is attached to the internal cable spool and the second end of the second cable is attached to the external spool. The external spool is in communication with an output gear affixed to a drive shaft. The drive shaft is operatively configured to pivotally connect a door hinge arm to the slide member. The motor selectively actuates the internal cable spool in a manner sufficient to pull the second cable toward the internal cable spool, thereby causing rotation of the external spool and the drive shaft. The rotation of the drive shaft results in rotation of the vehicle door relative to the vehicle body; after which door rotation, the door slides open along the guide track relative to the vehicle body.

BRIEF DESCRIPTION OF THE DRAWINGS

Features and advantages of embodiments of the present disclosure will become apparent by reference to the following detailed description and drawings, in which like reference numerals correspond to the same or similar, though perhaps not identical, components. For the sake of brevity, reference numerals or features having a previously described function may or may not necessarily be described in connection with other drawings in which they appear.

DETAILED DESCRIPTION

Motors for doors are traditionally implemented on the vehicle body due to space availability. However, the specific body architecture of a vehicle may significantly affect location, size and layout of the design for a motorized door when the motor is disposed on the vehicle body. The variations in different vehicle bodies may make it challenging to manufacture the same motorized door system across different vehicle programs.

In order to optimize cost and manufacturing processes among various vehicle programs, the present inventors have found that it would be desirable to implement a common (e.g., modular) motorized door system that may be implemented within a discrete door structure, and that also may be usable with various vehicle architectures.

Accordingly, the present disclosure provides a compact power drive unit 10 for use inside a vehicle door 12 which can advantageously provide improved vehicle space management and manufacturing efficiencies.

Figure 1:
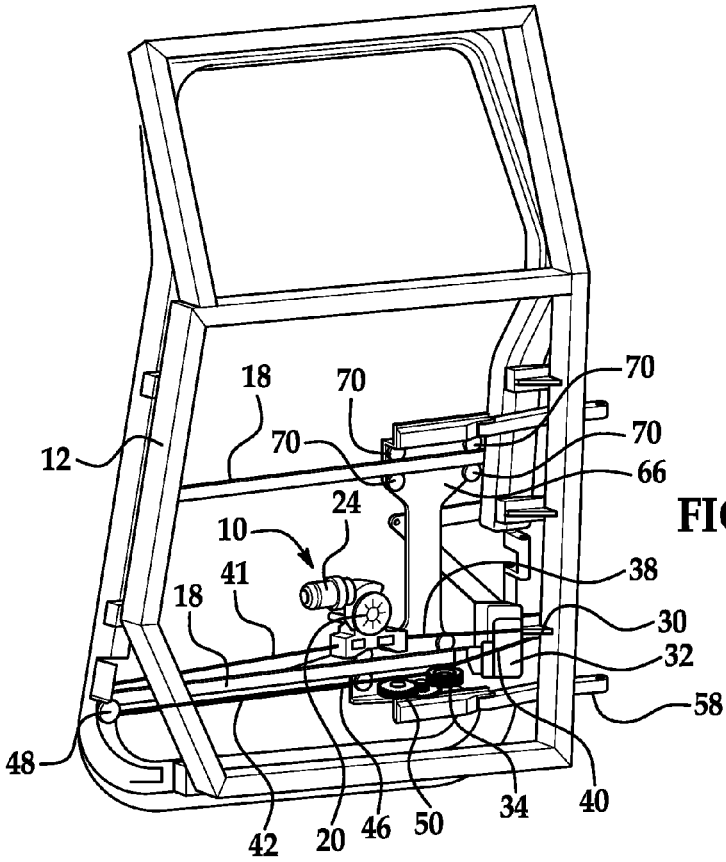
FIG. 1 is a perspective view of a vehicle door having an embodiment of the dual action power drive unit (door inner panel and door sheet metal not shown)

Referring now to FIG. 1, the dual action power drive unit 10 is shown installed on a vehicle door 12. The door sheet metal is not shown in FIG. 1 in order to facilitate the illustration of the dual action power drive unit 10 on the door 12. The power drive unit 10 is disposed within the vehicle door 12 unlike traditional motorized door systems that do not include a drive unit within a vehicle door. The arrangement of having the power drive unit 10 in the door 12, among other advantages, improves the manufacturability of such a system across various vehicle lines, given that the power drive unit 10 system is not as dependent on the vehicle architecture as traditional power drive unit systems that are housed on the vehicle body.

Figure 2:
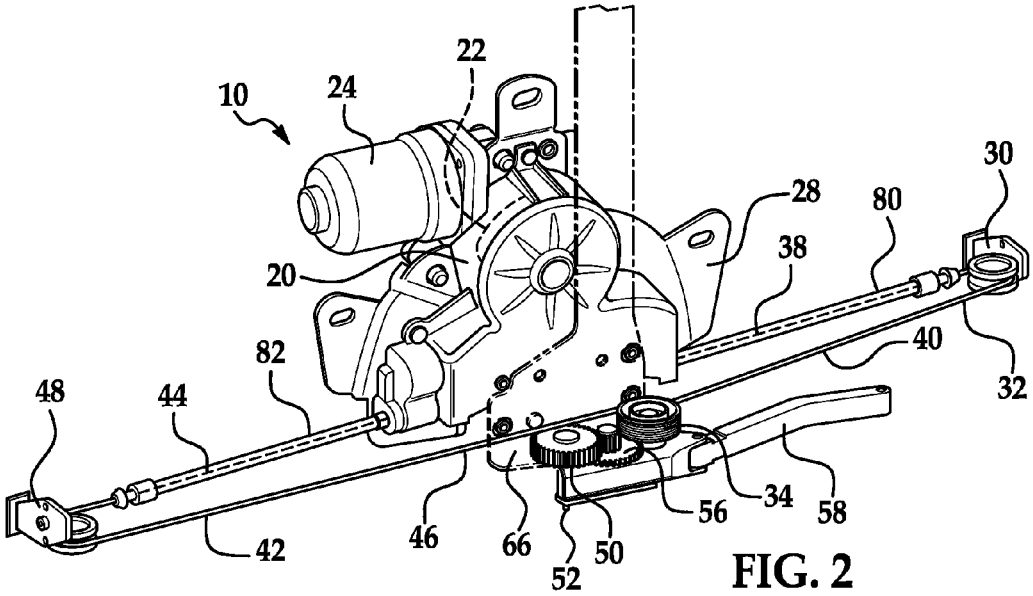
FIG. 2 is an enlarged isometric view of an embodiment of the dual action power drive unit for a vehicle door where the power drive unit is shown in isolation (slide member is shown in phantom)
Figure 6:
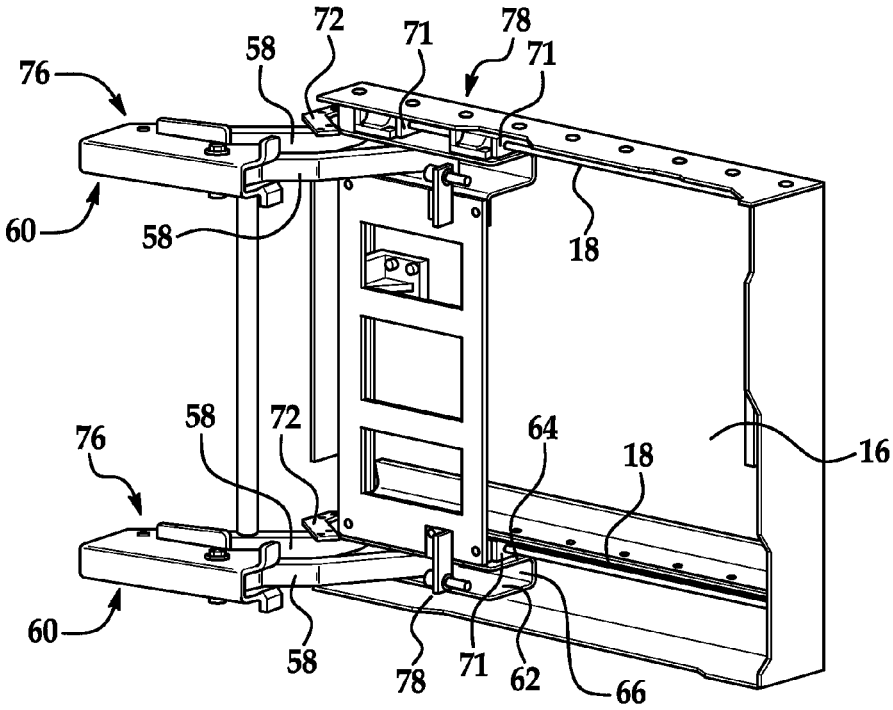
FIG. 6 is an isometric view of an example of a hinge and door system that may implement the dual action power drive unit.

Referring now to FIGS. 1 and 2 together, an isometric view of the dual action power drive unit 10 is shown in FIG. 2 and the dual action power drive unit 10 is shown installed in a door 12 in FIG. 1. The power drive unit 10, as indicated above, is disposed in the vehicle door 12. The vehicle door 12 includes a door inner panel 16 (shown in FIGS. 6-8) and at least one guide track 18 affixed to the door inner panel 16 (also shown in FIGS. 6-8). A slide member 66 is disposed on the at least one guide track 18. An internal spool unit 20 is affixed to the slide member 66, e.g., as shown in FIGS. 1 and 2. It is to be understood that the internal spool unit 20 includes an internal cable spool 22. The power drive unit 10 includes a motor 24 and a clutch (not shown), and the power drive unit 10 is affixed to the internal spool unit 20, e.g., as shown in FIG. 2. The motor 24 is in operative communication with the internal spool 22 through the use of a clutch (not shown). The clutch engages and disengages the motor 24 with the internal spool 22, in a manner traditionally known in the art.

With reference to FIG. 2, the power drive unit 10 system further includes a first cable guide member (shown as pulley 30 in FIG. 2) operatively associated with a first cable 32 and an external spool 34 or drum-like member. The first cable 32 includes a first end 38 and a second end 40. The first end 38 of the first cable 32 is attached to the internal cable spool 22. The second end 40 of the first cable 32 is attached to the external spool 34. It is to be understood that, as an alternative to cables, tape like or other cable like members may be used.

Connected to the internal spool 22 and opposite the first cable 32 as shown in FIGS. 1 and 2, a second cable guide member (shown as pulley 48 in FIG. 2) associated with a second cable 42 is provided to create a full cable loop for the motor 24. It is to be understood that pulleys 30, 48 are non-limiting examples of first and second cable guide members, and that other designs may be used. As other non-limiting examples, a bracket, or other cable guide member such as a plate, may be used as cable guide members, as alternates to first and second pulleys 30, 48.

Moreover, a non-limiting example of another cable design includes the first cable 32 and second cable 42 implemented as one continuous loop. Yet another example of the cable design includes separate cables attached to one another. A third non-limiting example includes the first cable 32 attached directly to the internal cable spool 22 and to the external spool 34; and the second cable 42 also attached directly to the internal cable spool 22 and to the external spool 34, thereby creating the operation of a full loop.

Referring back to FIG. 2, the second cable 42 includes a first end 44 and a second end 46. The first end 44 of the second cable 42 is attached to the internal cable spool 22. The second end of the second cable 42 is attached to the external spool 34.

Figure 3:
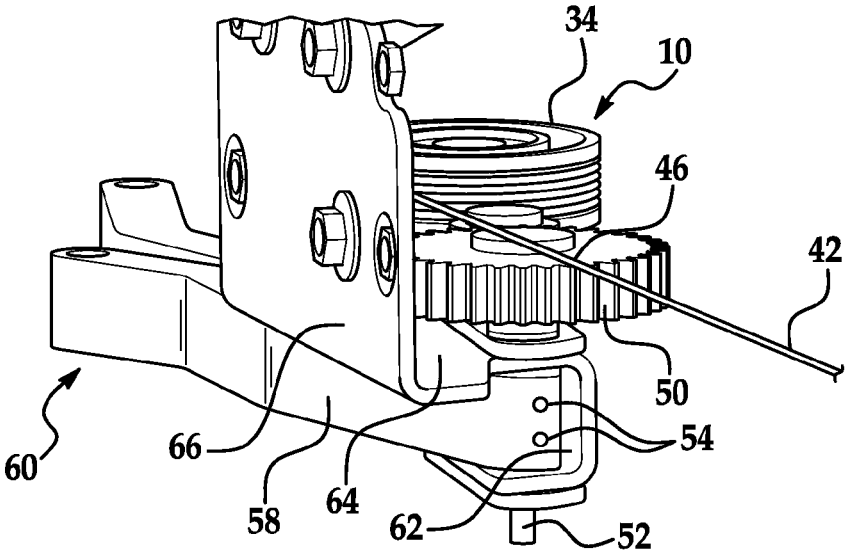
FIG. 3 is an enlarged, cutaway side view of an embodiment of the drive shaft, hinge arm, and slide member of the dual action power drive unit for a vehicle door.
Figure 4:
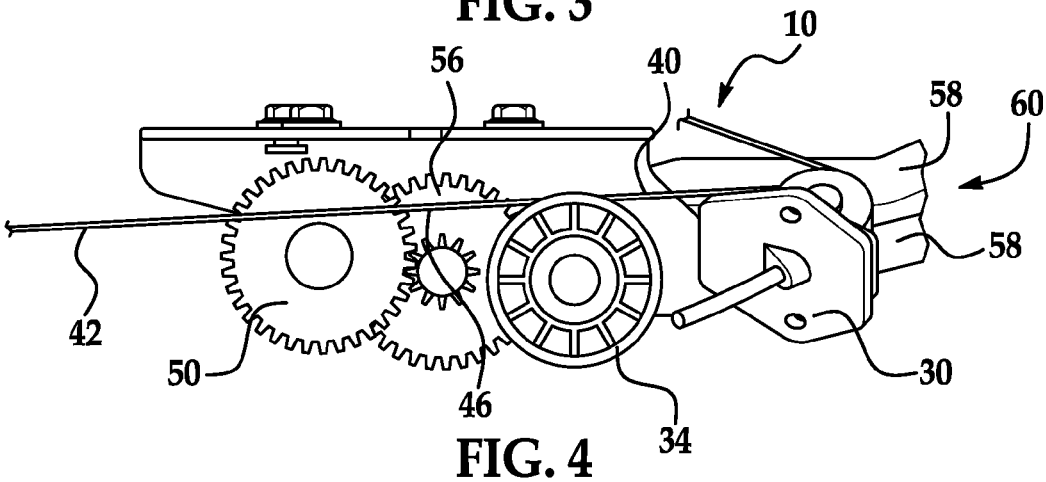
FIG. 4 is an enlarged, cutaway top view of an embodiment of the drive shaft, hinge arm, and slide member of the dual action power drive unit for a vehicle door.
Figure 5:
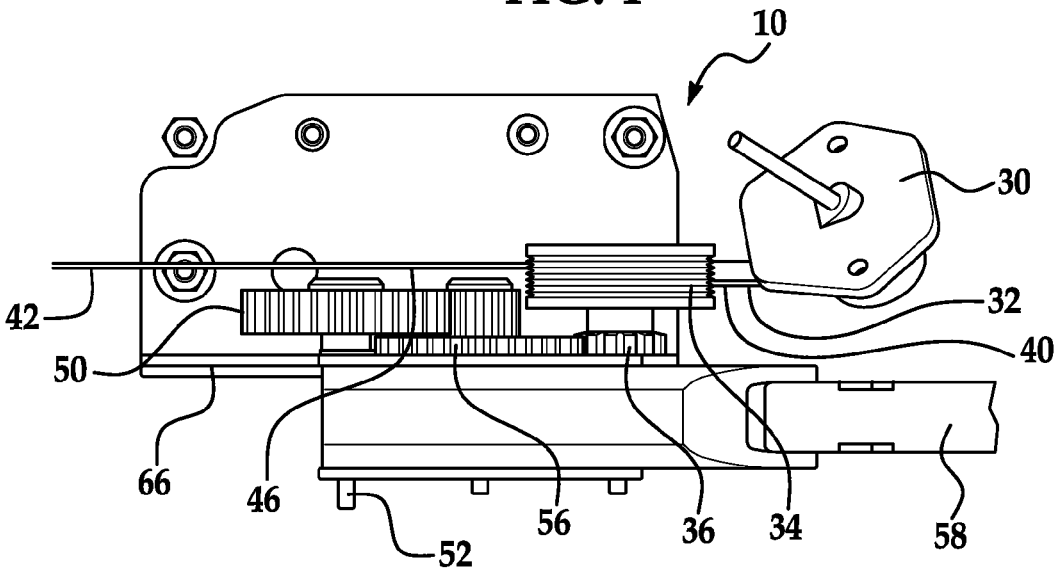
FIG. 5 is an enlarged, cutaway front view of an embodiment of the drive shaft, hinge arm, and slide member of the dual action power drive unit for a vehicle door.
Figure 10:
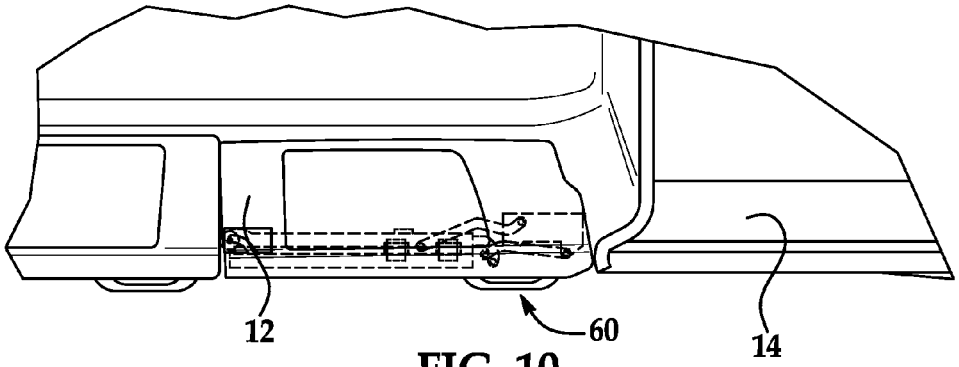
FIG. 10 is a cutaway top view of a vehicle door in the fully closed position where the vehicle implements the dual action power drive unit.
Figure 11:
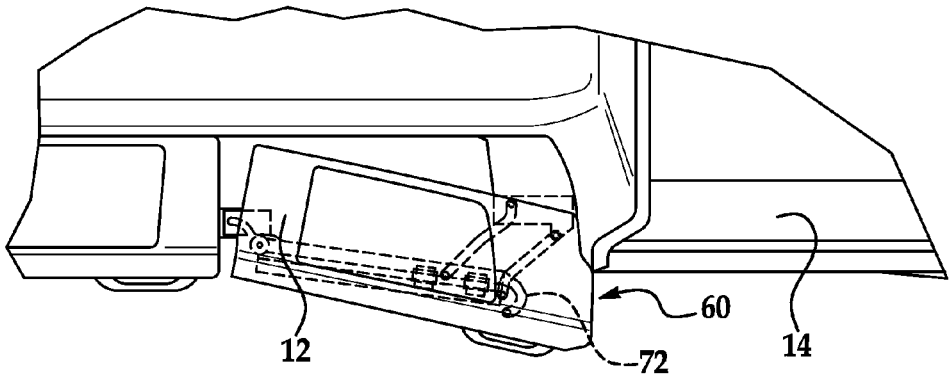
FIG. 11 is a cutaway top view of a vehicle door in the initially opening position where the vehicle implements an embodiment of the dual action power drive unit.
Figure 12:
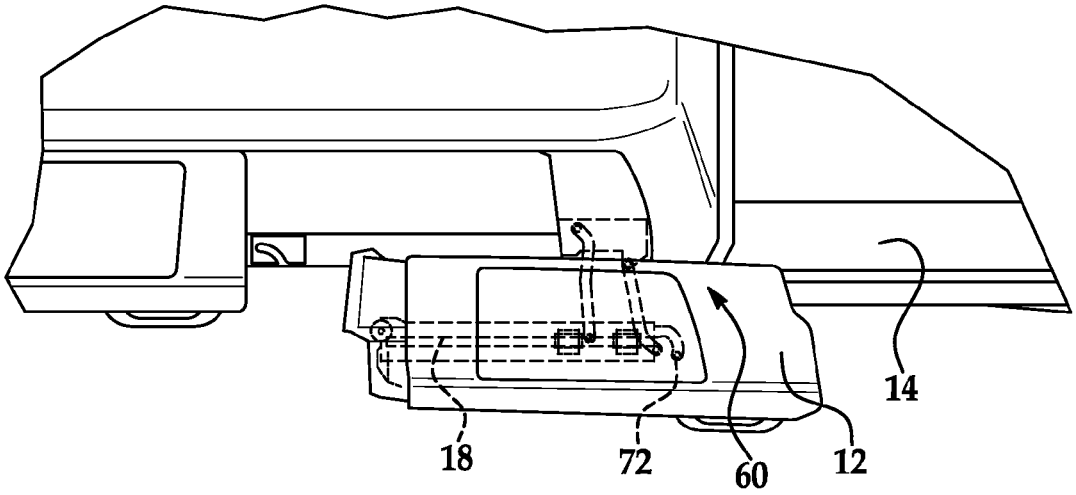
FIG. 12 is a cutaway top view of a vehicle door in the opening position where the vehicle implements an embodiment of the dual action power drive unit.

Referring now to FIGS. 2-5 together, the external spool 34 is in operative communication with an output gear 50 affixed to a drive shaft 52, e.g., as shown in FIGS. 3-5. Specifically, in the embodiment illustrated in FIGS. 3-5, the external spool 34 includes an external spool gear 36 which is in operative engagement with an intermediate gear 56. The intermediate gear 56 is, in turn, also in operative engagement with the output gear 50. The output gear 50 is affixed to or integral with the drive shaft 52. As shown in FIG. 3, the drive shaft 52 also serves as the pivot joint for the hinge arm 58 and the slide member 66. As one non-limiting example, the drive shaft 52 may include extensions 54 (as shown in FIG. 3) that are press fitted into the hinge arm 58 such that, as the drive shaft 52 rotates, the hinge arm 58 is also rotated accordingly so as to rotate the door in and out of the vehicle body as shown in FIGS. 10-12.

However, it is to be understood that a variety of configurations may be used in conjunction with the drive shaft 52 and the hinge arm 58 to cause the hinge arm 58 to rotate as the drive shaft 52 rotates. It is also to be understood that FIGS. 3-5 show one non-limiting example as to how the external spool 34 may be in communication with the drive shaft 52 through a single intermediate gear 56. It is to be understood that multiple intermediate gears 56 may be used in one alternative. It should also be appreciated that the external spool 34 may include gear 36 teeth that may interface directly with the output gear 50

Referring back to FIG. 2, the motor 24, via the clutch (not shown) then actuates the internal spool 22 to rotate so that the internal spool 22 pulls the second cable 42 toward the motor 24. The movement of the second cable 42 toward the motor 24 causes the rotation of the external spool 34. The rotation of the external spool 34, via the intermediate gear 56 (as shown in FIGS. 3-5), then causes the rotation of the drive shaft 52 through the teeth disposed on the output gear 50. The rotation of the drive shaft 52, through its unique configuration with the hinge arm 58 as discussed above, thereby results in the rotation of the vehicle door relative to the hinge arm 58 so as to open the vehicle door 12 out and away from the vehicle body. It is to be understood that once the full rotation has been reached (as shown in FIG. 12), the rotational movement between hinge arm 58 and the vehicle door 12 is halted such that, as second cable 42 is continually pulled by the internal spool 22 via the motor 24, the slide member 66 and the vehicle door 12 slide along the door guide track 18 to the fully opened position.

Figure 13:
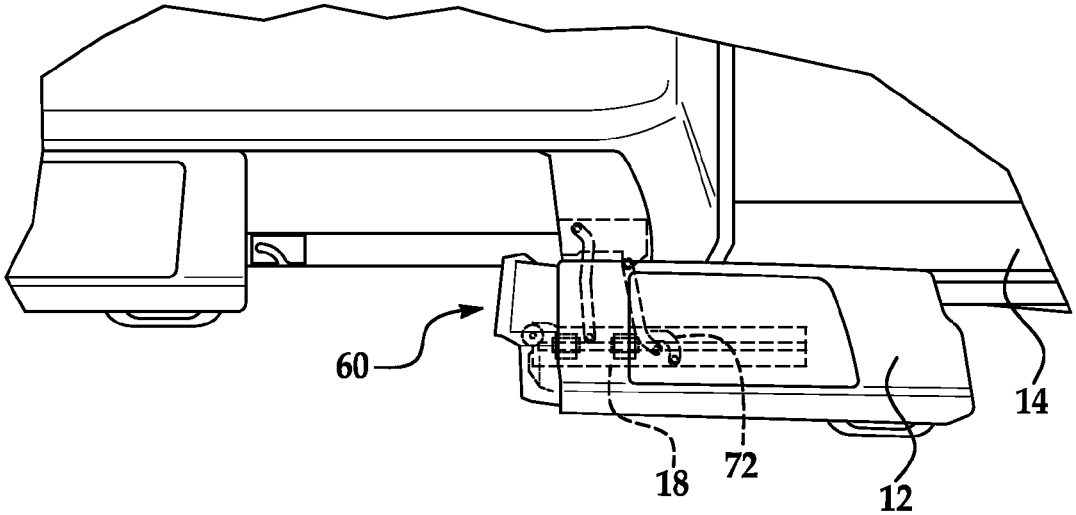
FIG. 13 is a cutaway top view of a vehicle door in the fully opened position where the vehicle implements an embodiment of the dual action power drive unit.

It is to be further understood that there is lost motion between the first and second cables 32, 42 and the external spool 34 as the door slides along the guide track 18 to the fully opened position. With reference to FIGS. 12 and 13, the external spool 34 and the gears 50, 56 (associated with external spool 34 and hinge arm 58) remain fixed to hold the door 12 in the "rotated-out" position as the internal spool 22 continues to pull the second cable 42 through the external spool 34. It is also to be understood that gears 50, 56 (and hinge arm 58) are no longer moving relative to one another as the door 12 is held in the outward position.

As shown in FIG. 2, the power drive unit 10 system may further include a mounting plate 28 affixed to the door inner panel 16 (shown in FIGS. 6-8), with the power drive unit 10 and the motor 24 being affixed to the mounting plate 28. Also as shown in FIG. 2, the power drive unit 10 system may further include a first cable cover 80 and a second cable cover 82. The first and second cable covers 80, 82 may be affixed to the internal spool unit 20 as shown.

A hinge 60 of the present disclosure may be a four bar link or similar link which allows for door pivot movement.

Regardless of the specific hinge design, the hinge 60 (as shown) includes a body side end 76 and a door side end 78. The body side end 76 of the hinge 60 is pivotally attached to the vehicle body 14, and the door side end 78 of the hinge 60 is pivotally attached to the slide member 66.

Figure 7:
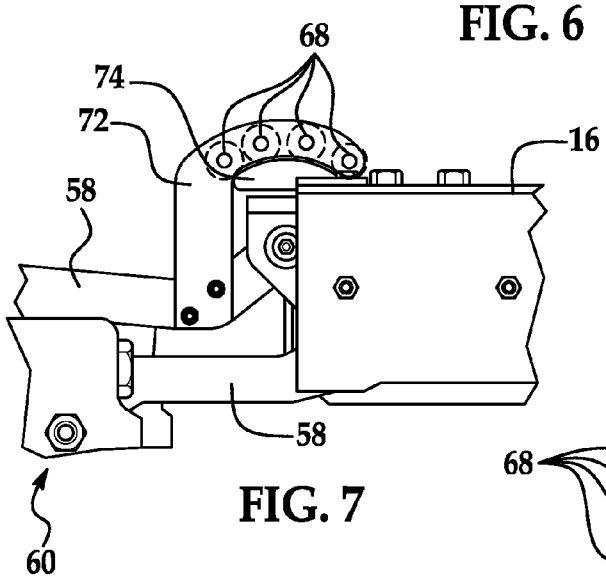
FIG. 7 is an enlarged, cutaway top view of an example for a J-hook for a hinge and door system that may implement the dual action power drive unit when the door is in the fully closed position.
Figure 8:
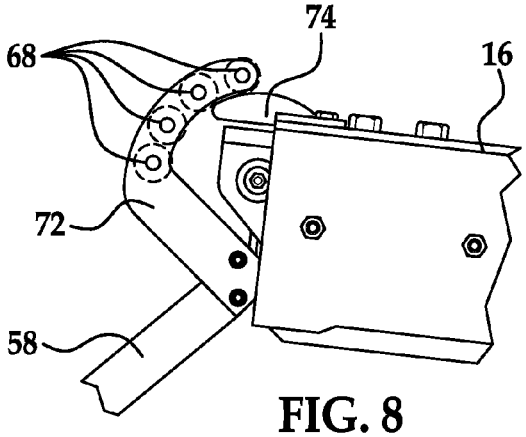
FIG. 8 is an enlarged, cutaway top view of an example of a J-hook for a hinge and door system that may implement the dual action power drive unit when the door is in the initially opening position and the first cable is being actuated by the motor.
Figure 9:
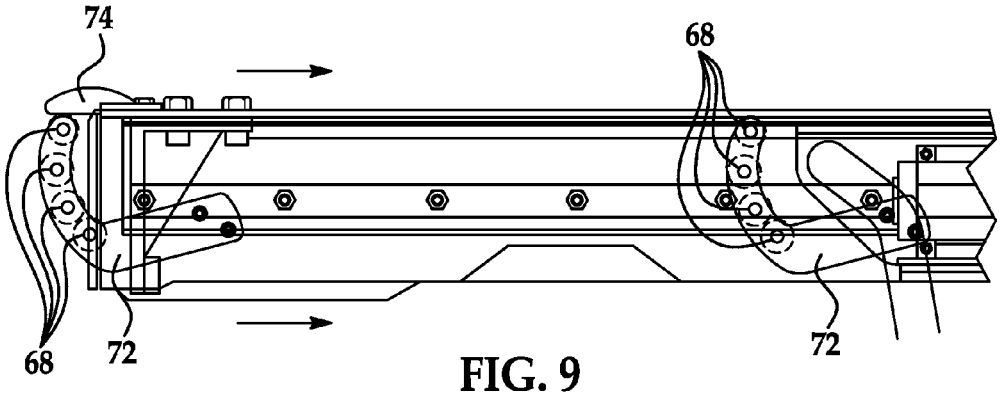
FIG. 9 is a cutaway top view of an example of a hinge and door system that may implement the dual action power drive unit as the door is sliding to the fully open position and the second cable is being actuated.

As shown in FIGS. 3-6, the power drive unit 10 system may include a slide member 66 wherein the slide member 66 is a stamped member. However, it is to be understood that this is one non-limiting example of a slide member 66, and that a variety of structures may be used, such as a cast block that slides within the guide track 18.

Where the slide member 66 is a stamped member as shown in FIGS. 3-6, the stamped slide member 66 may include a first recess 62 and a second recess 64. The first recess 62 receives the hinge arm 58, and the second recess 64 may receive a plurality of rollers 70. The plurality of rollers 70 is operatively configured to move along the guide track 18. As shown in FIGS. 7, 8 and 11, a cam 74 and J-hook 72 guides the door 12 into a pivoting movement as the motor 24 initially pulls the second cable 42 and then the guide track 18 guides the door 12 into a translating or sliding movement as the motor 24 continues to pull the second cable 42. It is to be understood that the motor 24 may then be powered down, and the clutch (not shown) may disengage the motor 24 from the internal spool 22 once the door 12 reaches its fully opened position as shown in FIG. 13.

It is also to be understood that the motor 24 may be disengaged via the clutch (not shown) from the looped cable system 32, 42 so that the door could be manually opened and closed without the use of the motor 24. By disengaging the motor 24 from the looped cable system 32 and 42, the external spool 34 and the internal spool 22 may rotate with and/or slide relative to the first and second cables 32, 42 as the first and second cables are pulled through the external spool 34 and internal spool 22 during the manual opening and closing of the door.

Referring now to FIGS. 6-13 together, a non-limiting example of a door 12 and hinge 60 system is shown. The illustrated system includes a stamped sliding member 66 as in the example of FIGS. 1-5. It is to be understood that the illustrated door 12 and hinge 60 system and the associated sliding member 66 of FIGS. 6-13 is a non-limiting example of an environment that may implement and house the dual action power drive unit 10 system.

Referring now to FIG. 7, there is shown a cutaway top view of an example for a J-hook 72 for a hinge 60 and door 12 system having the dual action power drive unit 10. The door 12 is in a closed state, and the J-hook 72 is disposed on the cam 74 which may be affixed in the door 12. However, it is to be understood that there may be alternative door configurations which may implement the cam external to the door or partially internal to the door. The J-hook 72 includes rollers 68 on its substantially curved arm to cause the door 12 to pivot and not slide as the cam 74 moves along the rollers 68. In order for the J-hook 72 and its rollers 68 to overcome the cam 74 (as shown in FIG. 8), the motor 24 of the power drive unit 10 actuates the internal spool 22 so that the second cable 42 is pulled toward the internal spool 22. The movement of the second cable 42 toward the motor 24 causes the rotation of the external spool 34. The rotation of the external spool 34, via the intermediate gear 56 (as shown in FIGS. 3-5), then causes the rotation of the drive shaft 52 through the teeth disposed on the output gear 50. The rotation of the drive shaft 52, through its unique configuration with the hinge arm 58 (as discussed above) causes movement in the hinge arm 58 so that the door 12 is moved away from the vehicle.

FIGS. 10-12 together illustrate the motion of the vehicle door 12 as the second cable 42 is initially pulled by the motor 24 until the second cable 42 has been completely pulled to its end, and the door 12 is in the fully pivoted state and fully opened position.

In order to close the door 12, the motor 24, via the clutch (not shown), then actuates the internal spool 22 so that it pulls the first cable 32 toward the motor 24. As the first cable 32 is pulled toward the motor 24, the door 12 moves relative to the sliding member along the guide track 18 so that the door 12 is translated in a substantially linear direction to the fully pivoted state and then to the fully closed position.

It is to be understood that the terms "associate/associated with" "communicates/in communication with" and/or the like are broadly defined herein to encompass a variety of divergent arrangements and assembly techniques. These arrangements and techniques include, but are not limited to (1) the direct communication between one component and another component with no intervening components therebetween; and (2) the communication of one component and another component with one or more components therebetween, provided that the one component being "associated/communicating with" the other component is somehow in operative communication with the other component (notwithstanding the presence of one or more additional components therebetween).

While multiple embodiments have been described in detail, it will be apparent to those skilled in the art that the disclosed embodiments may be modified. Therefore, the foregoing description is to be considered exemplary rather than limiting.

What is claimed is:

1. A power drive unit system for use inside a vehicle door, the power drive unit system comprising:

a vehicle door having a door inner panel and at least one guide track affixed to the door inner panel;

a slide member disposed on the at least one guide track;

a spool unit affixed to the slide member, the spool unit including a first cable spool;

a motor disposed proximate to the first cable spool, the motor being disposed within the door and in operative communication with the first cable spool;

a first cable guide member operatively associated with a first cable and a second spool, the first cable having a first end and a second end, the first end of the first cable being attached to the first cable spool, and the second end of the first cable being attached to the second spool; and a second cable guide member operatively associated with a second cable and the second spool, the second cable having a first end and a second end, the first end of the second cable being attached to the first cable spool, and the second end of the second cable being attached to the second spool, the second spool being in communication with an output gear affixed to a drive shaft, the drive shaft being operatively configured to pivotally connect a door hinge arm to the slide member;

whereby the motor selectively actuates the first cable spool in a manner sufficient to pull the second cable toward the first cable spool, thereby causing rotation of the second spool and the drive shaft, the rotation of the drive shaft resulting in: rotation of the vehicle door relative to the vehicle body; after which door rotation, the door slides open along the guide track relative to the vehicle body.

2. The power drive unit system of claim 1, further comprising a mounting plate affixed to the door inner panel, the motor being affixed to the mounting plate.

3. The power drive unit system of claim 1, further comprising a first cable cover and a second cable cover, the first and second cable covers being affixed to the first spool unit.

4. The power drive unit system of claim 3 wherein the door hinge arm is part of a four bar link.

5. The power drive unit system of claim 4 wherein a hinge of the door hinge arm includes a body side end and a door side end, the body side end of the hinge being pivotally attached to the vehicle body, and the door side end of the hinge being pivotally attached to the slide member.

6. The power drive unit system of claim 1 wherein the slide member is a stamped member.

7. The power drive unit system of claim 6 wherein the slide member includes a first recess and a second recess, the first recess receiving the door hinge arm, and the second recess receiving a plurality of rollers, the plurality of rollers being operatively configured to move along the guide track.

8. The power drive unit system of claim 1 wherein the first cable guide member is a first pulley, and the second cable guide member is a second pulley.

9. A power drive unit system for use inside a vehicle door, the power drive unit system comprising:

a vehicle door having a door inner panel and at least one guide track affixed to the door inner panel;

a slide member disposed on the at least one guide track;

a motor disposed proximate to, and in operative communication with a first spool, the motor and the first spool being disposed within the vehicle door;

a first cable guide member operatively associated with a first cable and a second spool, the first cable being in operative communication with the motor and the second spool;

a second cable guide member operatively associated with a second cable and the second spool, the second cable being in operative communication with the motor and the second spool; and the second spool being in communication with an output gear affixed to a drive shaft, the drive shaft being operatively configured to pivotally connect a door hinge arm to the slide member;

whereby the motor and the first spool selectively pull the second cable, thereby causing rotation of the second spool and the drive shaft, the rotation of the drive shaft resulting in: rotation of the door relative to the vehicle body; after which door rotation, the vehicle door slides open along the guide track to a fully opened position.

10. The power drive unit system of claim 9, further comprising a mounting plate affixed to the door inner panel, the power drive unit and the motor being affixed to the mounting plate.

11. The power drive unit system of claim 9, further comprising a first cable cover and a second cable cover, the first and second cable covers being operatively affixed to a cover for the first spool.

12. The power drive unit system of claim 9 wherein the hinge arm is part of a four bar link.

13. The power drive unit system of claim 12 wherein a hinge of the door hinge arm includes a body side end and a door side end, the body side end of the hinge being pivotally attached to a vehicle body, and the door side end of the hinge being pivotally attached to the slide member.

14. The power drive unit system of claim 9 wherein the slide member is a stamped member.

15. The power drive unit system of claim 9 wherein the slide member includes a first recess and a second recess, the first recess receiving the door hinge arm, and the second recess having a plurality of rollers, the plurality of rollers being operatively configured to move along the guide track.

16. The power drive unit system of claim 9 wherein the first cable guide member is a first pulley and the second cable guide member is a second pulley.

* * * * *